US007789249B1

(12) United States Patent
Merbeth

(10) Patent No.: US 7,789,249 B1
(45) Date of Patent: Sep. 7, 2010

(54) AWARD RACKS

(76) Inventor: Laura J. Merbeth, N56 W27034 Hwy. K, Sussex, WI (US) 53089

( * ) Notice: Subject to any disclaimer, the term of this patent is extended or adjusted under 35 U.S.C. 154(b) by 0 days.

(21) Appl. No.: 12/713,568

(22) Filed: Feb. 26, 2010

Related U.S. Application Data

(63) Continuation-in-part of application No. 11/781,411, filed on Jul. 23, 2007, now Pat. No. 7,726,495.

(60) Provisional application No. 60/835,050, filed on Aug. 2, 2006.

(51) Int. Cl.
*A47F 5/08* (2006.01)

(52) U.S. Cl. ..... 211/87.01

(58) Field of Classification Search ..... 211/118, 211/113, 87.01, 123, 105.1, 85.7; 224/578, 224/579, 580, 493
See application file for complete search history.

(56) References Cited

U.S. PATENT DOCUMENTS

| | | | | | |
|---|---|---|---|---|---|
| 1,571,000 | A | * | 1/1926 | Eustis et al. | 211/65 |
| 1,575,270 | A | * | 3/1926 | Jankowsky | 211/87.01 |
| 2,546,720 | A | * | 3/1951 | Brothers | 211/85.3 |
| D163,637 | S | * | 6/1951 | Roop | D6/563 |
| D172,842 | S | * | 8/1954 | Scheer et al. | D6/564 |
| 2,964,196 | A | * | 12/1960 | Phillips | 211/85.3 |
| 3,361,266 | A | | 1/1968 | Williams | |
| 4,052,805 | A | * | 10/1977 | Potter | 40/124 |
| 4,441,583 | A | * | 4/1984 | Vaught | 182/150 |
| 4,523,526 | A | * | 6/1985 | O'Neill | 108/149 |
| 4,561,547 | A | * | 12/1985 | Estwanik, III | 211/14 |
| 4,714,166 | A | * | 12/1987 | Hann et al. | 211/94.01 |
| 4,872,568 | A | * | 10/1989 | Lehmann | 211/113 |
| 4,874,100 | A | * | 10/1989 | Smagula | 211/60.1 |
| 4,998,647 | A | * | 3/1991 | Sharp | 222/143 |
| 5,020,677 | A | * | 6/1991 | Wirth et al. | 211/113 |
| 5,107,996 | A | * | 4/1992 | Whittaker | 211/116 |
| D328,681 | S | * | 8/1992 | Radosevich | D6/571 |
| D336,378 | S | * | 6/1993 | Kittridge | D6/344 |
| 5,326,175 | A | * | 7/1994 | Carter | 383/22 |
| 5,407,111 | A | * | 4/1995 | Lanouette et al. | 224/579 |
| 5,836,486 | A | * | 11/1998 | Ohsugi | 223/85 |
| 6,000,591 | A | * | 12/1999 | Alexander | 224/257 |
| 6,029,830 | A | * | 2/2000 | Manookian | 211/87.01 |
| D446,658 | S | * | 8/2001 | Osborne | D6/316 |
| 6,308,837 | B1 | * | 10/2001 | Bragg et al. | 211/13.1 |
| D503,854 | S | * | 4/2005 | Hess | D6/326 |
| 7,152,535 | B2 | * | 12/2006 | Mikich et al. | 108/42 |

(Continued)

*Primary Examiner*—Jennifer E. Novosad
(74) *Attorney, Agent, or Firm*—Donald J. Ersler

(57) ABSTRACT

An award rack includes a strip of material. The strip of material includes an offset portion formed on each end. A fastener opening is formed through each offset portion. A substantial middle portion is created between the two offset portions. The award rack is attached to a flat surface with fasteners. A second embodiment of the award rack includes a strip of material, a pair of strap holders and a pair of straps. The pair of strap holders are attached to the strip of material and a pair of strap holders retain the pair of straps. A third embodiment of the award rack preferably includes a shelf, a first rack, a second and at least one figurine. The third embodiment of the award rack is preferably formed from a single plate. A fourth embodiment of the award rack includes at least two bar hangers and at least one notched bar.

10 Claims, 6 Drawing Sheets

U.S. PATENT DOCUMENTS

| | | | | |
|---|---|---|---|---|
| 7,726,495 | B1 * | 6/2010 | Merbeth | 211/87.01 |
| 2003/0150828 | A1 * | 8/2003 | Bennett et al. | 211/118 |
| 2006/0016772 | A1 * | 1/2006 | Plzak | 211/70.6 |
| 2006/0049124 | A1 * | 3/2006 | Wang | 211/113 |
| 2006/0186071 | A1 * | 8/2006 | Rowan et al. | 211/113 |
| 2006/0207952 | A1 * | 9/2006 | Timmons | 211/85.3 |
| 2006/0207956 | A1 * | 9/2006 | Sivers | 211/113 |
| 2007/0029271 | A1 * | 2/2007 | Belokin et al. | 211/113 |
| 2007/0095768 | A1 * | 5/2007 | Huo | 211/113 |
| 2007/0102380 | A1 * | 5/2007 | Shaw | 211/70.5 |
| 2009/0184077 | A1 * | 7/2009 | Curet et al. | 211/117 |

* cited by examiner

AWARD RACKS

CROSS-REFERENCES TO RELATED APPLICATIONS

This is a continuation-in-part patent application taking priority from nonprovisional application Ser. No. 11/781,411 filed on Jul. 23, 2007 now U.S. Pat. No. 7,726,495, which takes priority from provisional application No. 60/835,050 filed on Aug. 2, 2006.

BACKGROUND OF THE INVENTION

1. Field of the Invention

The present invention relates generally to displaying awards and more specifically to award racks, which provide a convenient way of displaying ribbons, metals and trophies.

2. Discussion of the Prior Art

There are numerous devices for displaying trophies. However, it appears there are far fewer devices for displaying metals and ribbons. U.S. Pat. No. 3,361,266 to Williams discloses a tie rack. The Williams patent includes a strip of metal that is bent to receive a plurality of clip ties.

Accordingly, there is a clearly felt need in the art for award racks, which are capable of displaying ribbons, metals and trophies with a minimum of complexity.

SUMMARY OF THE INVENTION

The present invention provides award racks, which include a convenient way of displaying ribbons, metals and trophies. The award rack includes a strip of material. The strip of material includes an offset portion formed on each end. A fastener opening is formed through each offset portion. A substantial middle portion is formed between the two offset portions. The award rack is attached to a flat surface by inserting a fastener through each offset opening and engaging the fastener with the flat surface. As a result of attaching the award rack to the flat surface, a mounting gap is formed between a back of the substantial middle portion and a front of the flat surface. Ribbons may be mounted to a top edge of the substantial middle portion. A figurine may extend from each offset portion.

A second embodiment of the award rack includes a strip of material, a pair of strap holders and a pair of straps. A figurine preferably extends from each end of the strip of material. Each strap holder includes a strap leg, an offset leg and a mounting leg. The strap leg extends from one end of the offset leg and the mounting leg extends from the other end of the offset leg in a direction opposite the strap leg. A strap slot is formed through the strap leg to receive a strap. The mounting leg is mounted to one end of the strip of material or to the figurine.

Each strap includes a strap member, a male locking member and a female locking member. One end of the strap member is secured to the male locking member and the other end of the strap member is secured to the female locking member. The female locking member is sized to receive the male locking member. The second embodiment of the award rack is hung from a horizontal support utilizing the pair of straps. Ribbons may be mounted to a top edge of the strip of material.

A third embodiment of the award rack preferably includes a shelf, a first rack, a second rack and at least one figurine. The third embodiment of the award rack is preferably formed from a single plate. The first rack is formed by creating a first opening above a bottom of the plate. A substantial first middle section of the first rack is offset forward from each end thereof. The second rack is formed by creating a second opening above the first opening. A substantial second middle section of the second rack is offset forward from each end thereof. The shelf is preferably formed by cutting first and second slots at substantially the ends of a top of the plate. The material between the first and second slots is bent downward perpendicular to the plate. The at least one figurine is preferably formed in at least one top corner of the plate with laser cutting.

A fourth embodiment of the award rack includes at least two bar hangers and at least one notched bar. Each bar hanger includes a hanger body and an edge hanger end that extends from one end of the hanger body. The hanger body includes a U-shaped cross section. A plurality of first slots are formed along a first side of the hanger body and a plurality of second slots are formed along an opposing second side of the hanger body. The notch bar includes a first notch formed on a first end and a second notch formed on a second end. The first and second notches are sized to be received by first and second slots of two adjacent bar hangers. The edge hanger end is received by a top edge of an object. A plurality of notched bars may be hung between two adjacent bar hangers.

Accordingly, it is an object of the present invention to provide an award rack, which may be mounted flush to a wall.

It is a further object of the present invention to provide an award rack, which includes a pair of straps for hanging from a horizontal support.

It is another object of the present invention to provide an award rack, which includes a shelf and two racks that are formed from a single piece of material.

Finally, it is another object of the present invention to provide an award rack, which includes at least two bar hangers and at least one notched bar that is hung between two adjacent bar hangers.

These and additional objects, advantages, features and benefits of the present invention will become apparent from the following specification.

DETAILED DESCRIPTION OF THE PREFERRED EMBODIMENTS

Figure 1:
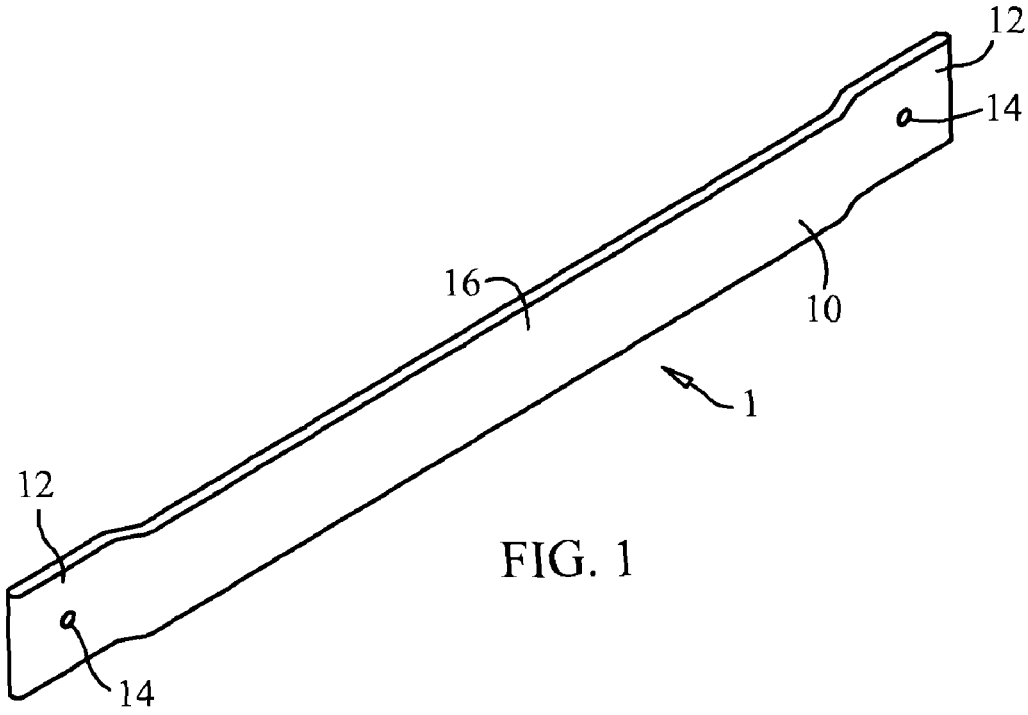
FIG. 1 is a perspective view of an award rack in accordance with the present invention.

With reference now to the drawings, and particularly to FIG. 1, there is shown a perspective view of an award rack 1.

Figure 1A:
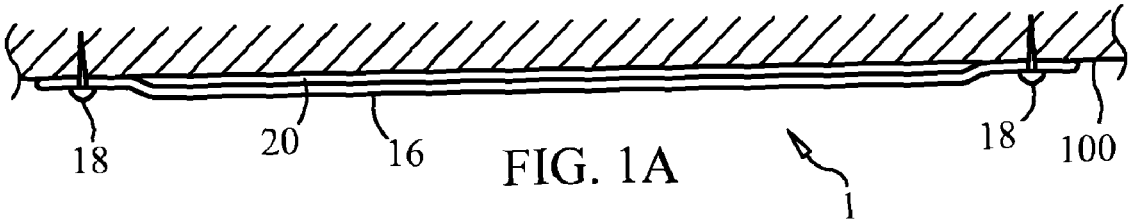
FIG. 1*a* is a top view of an award rack in accordance with the present invention.
Figure 2:
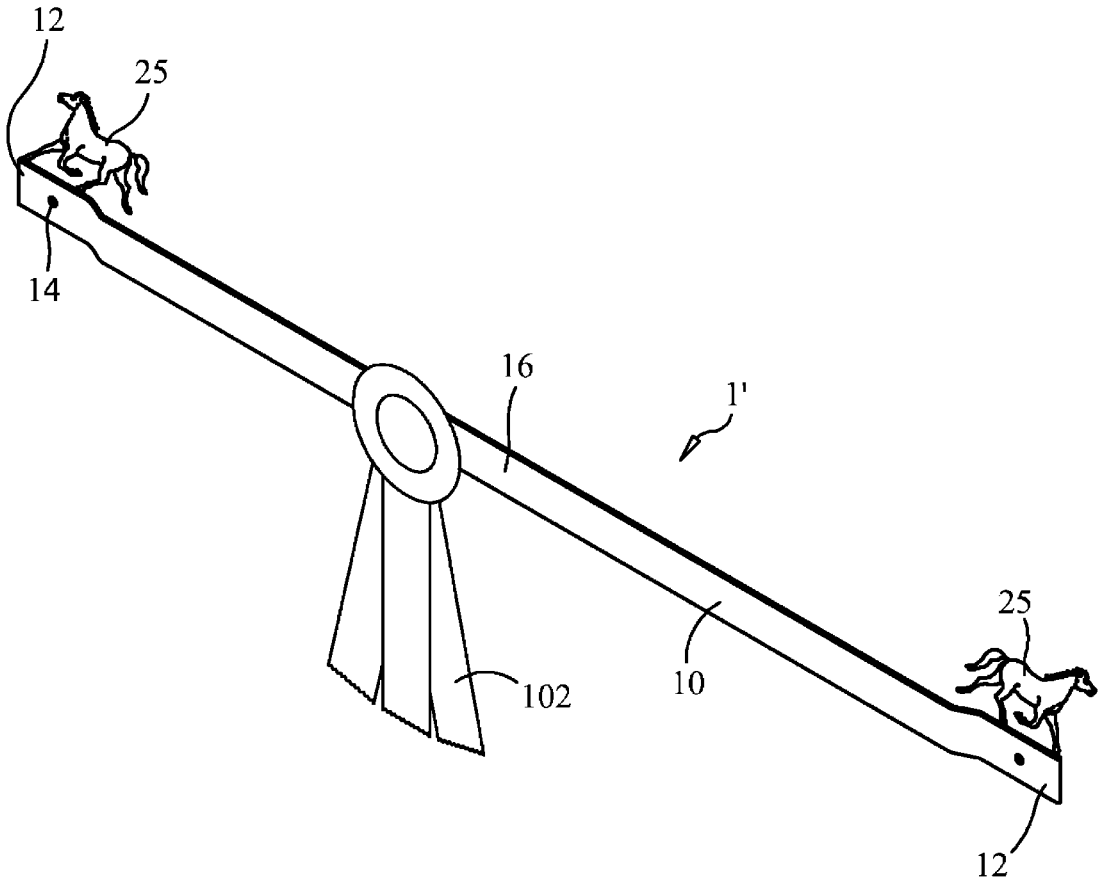
FIG. 2 is a perspective view of an award rack with a figurine formed on each end thereof in accordance with the present invention.

The award rack 1 includes a strip of material 10. The strip of material 10 includes an offset portion 12 formed on each end. A fastener opening 14 is formed through each offset portion 12. A substantial middle portion 16 is formed between the two offset portions 12. With reference to FIG. 1*a*, the award rack 1 is attached to a flat surface 100 such as a wall by inserting a fastener 18 through each offset opening 14 and engaging the fastener 18 with the flat surface 100. As a result of attaching the award rack 1 to the flat surface 100, a mounting gap 20 is formed between a back of the substantial middle portion 16 and a front of the flat surface 100. With reference to FIG. 2, an award rack 1' includes a figurine 25 extending from each offset portion 12. A ribbon 102 may be mounted to a top edge of the middle portion 16.

Figure 3:
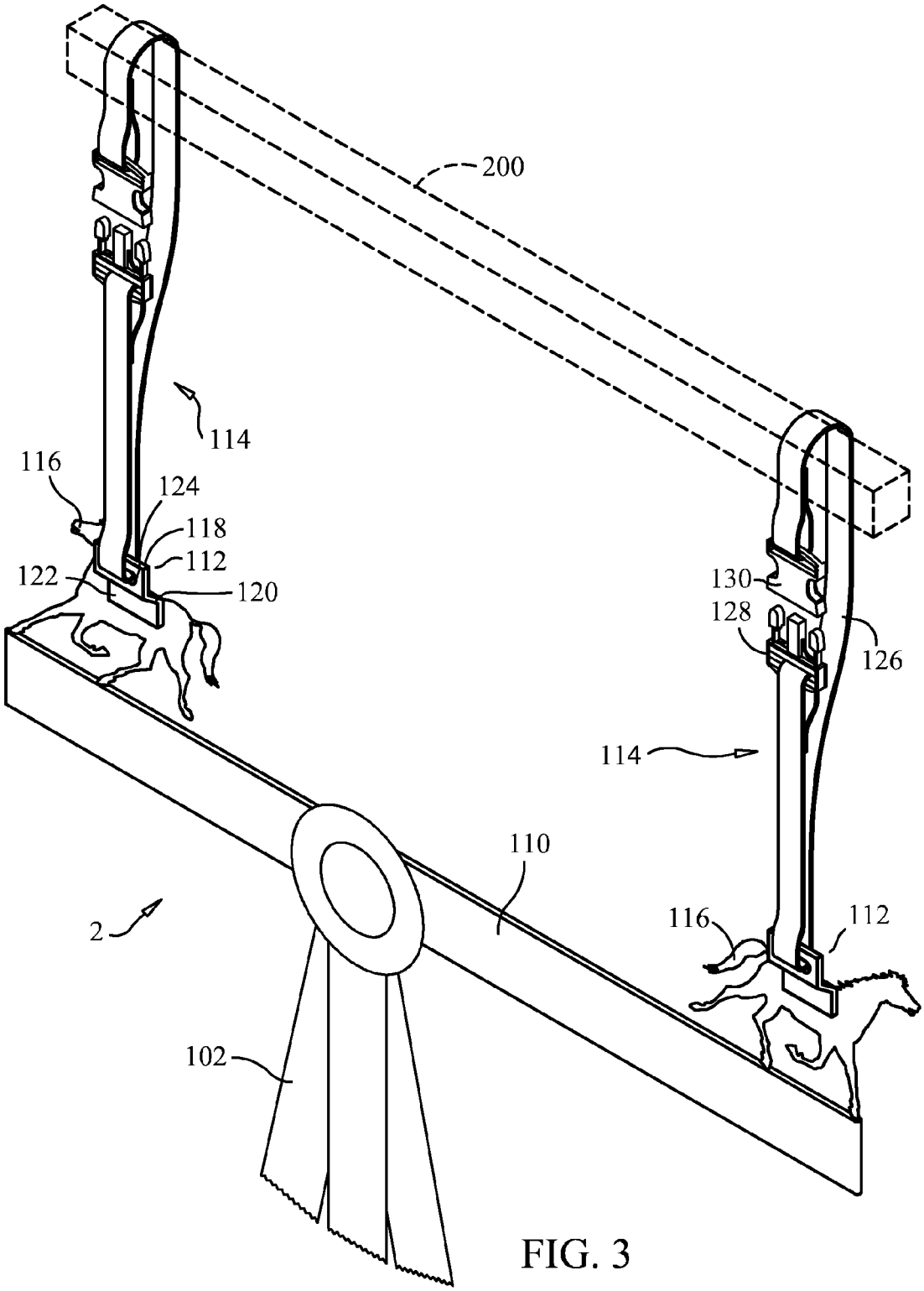
FIG. 3 is a perspective view of a second embodiment of an award rack in accordance with the present invention.

With reference to FIG. 3, a second embodiment of the award rack 2 includes a strip of material 110, a pair of strap holders 112 and a pair of straps 114. A figurine 116 preferably extends from each end of the strip of material 110. Each strap holder 112 preferably includes a strap leg 118, an offset leg 120 and a mounting leg 122. The strap leg 118 extends from one end of the offset leg 120 and the mounting leg 122 extends from the other end of the offset leg 120 in a direction opposite the strap leg 118. A strap slot 124 is formed through the strap leg 118 to receive the strap 114. The mounting leg 122 is attached to an end of the strip of material 110 or to the figurine 116 with welding or any other suitable attachment method. The figurine 116 preferably represents the subject matter of the award. For example, a horse figurine is used for an award given at a horse show.

Each strap 114 includes a strap member 126, a male locking member 128 and a female locking member 130. One end of the strap member 126 is secured to the male locking member 128 and the other end of the strap member 126 is secured to the female locking member 130. The female locking member 130 is sized to receive the male locking member 128. The award rack 2 is hung from a horizontal support 200 utilizing the pair of straps 114. Ribbons 102 may be mounted to a top edge of the strip of material 110.

Figure 4:
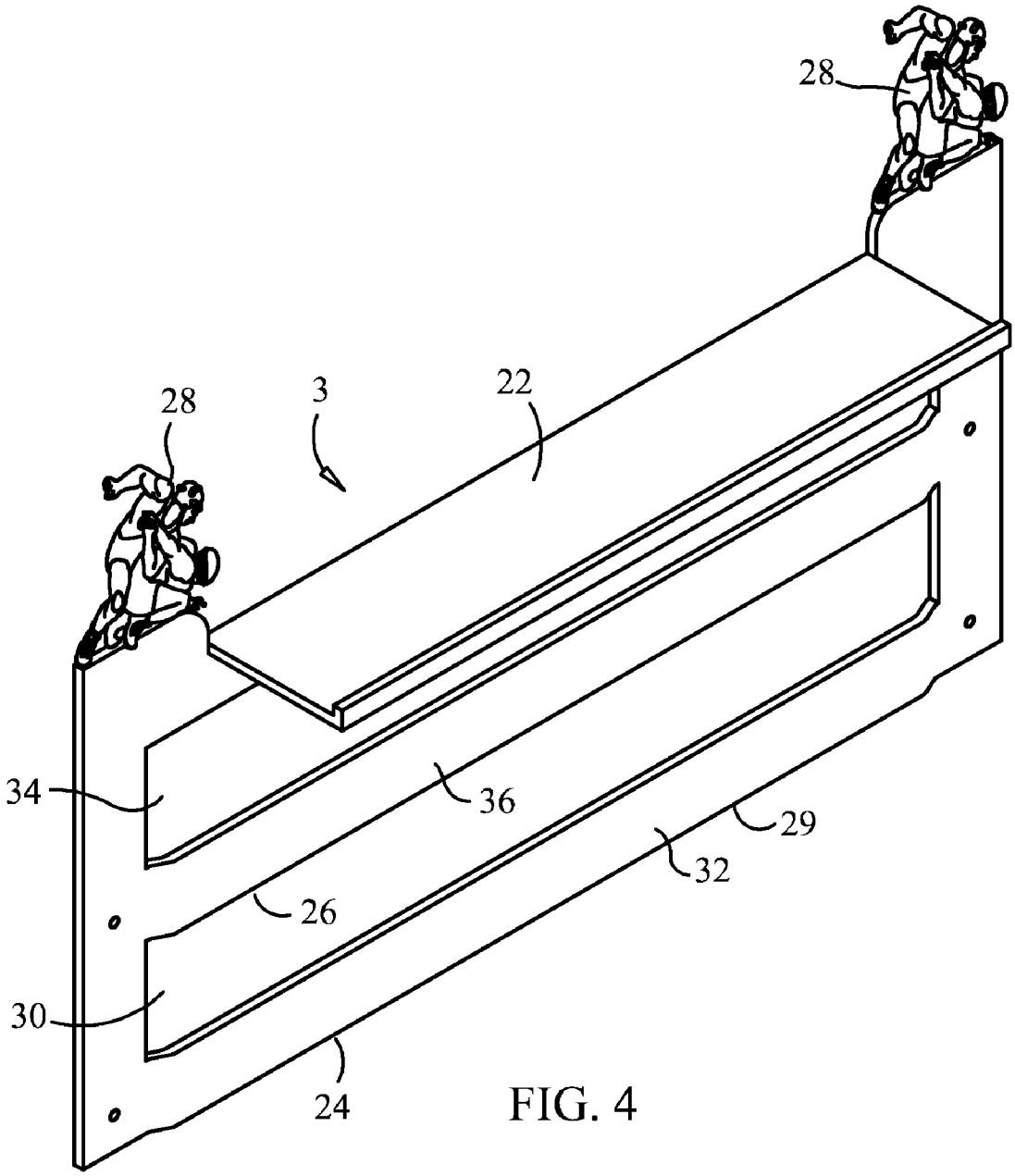
FIG. 4 is a perspective view of a third embodiment of an award rack in accordance with the present invention.

With reference to FIG. 4, a third embodiment of the award rack 3 preferably includes a shelf 22, a first rack 24, a second rack 26 and at least one figurine 28. The award rack 3 is preferably formed from a single plate 29. The first rack 24 is formed by creating a first opening 30 above a bottom of the plate 29. A substantial first middle section 32 of the first rack 24 is offset forward from each end thereof. The second rack 26 is formed by creating a second opening 34 above the first opening 30. A substantial second middle section 36 of the second rack 26 is offset forward from each end thereof. The shelf 22 is preferably formed by cutting first and second slots at substantially the ends of a top of the plate 29. The material between the first and second slots is bent downward perpendicular to the plate 29. The at least one figurine 28 is preferably formed in at least one top corner of the plate 28 with laser cutting.

Figure 5:
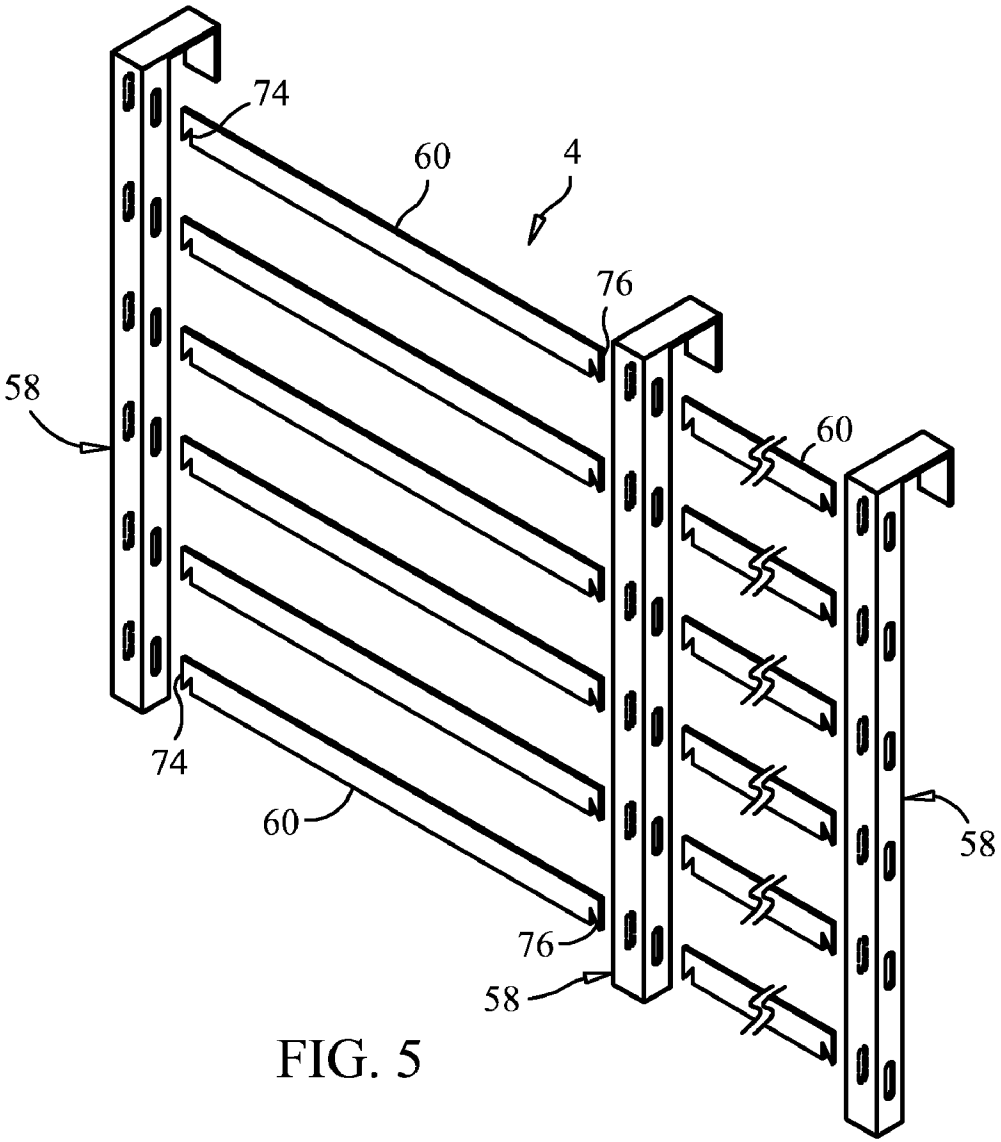
FIG. 5 is an exploded perspective view of a fourth embodiment of an award rack in accordance with the present invention.
Figure 8:
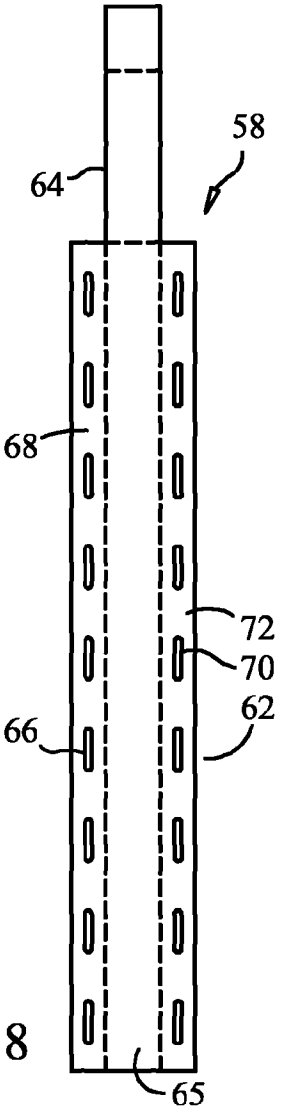
FIG. 8 is a top view of an unformed bar hanger of a fourth embodiment of an award rack in accordance with the present invention.
Figure 7:
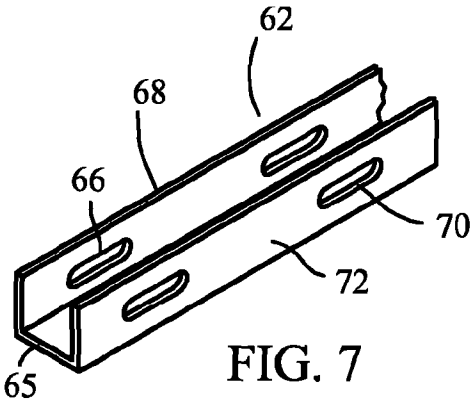
FIG. 7 is a perspective view of a portion of a hanger body of a fourth embodiment of an award rack in accordance with the present invention.
Figure 6:
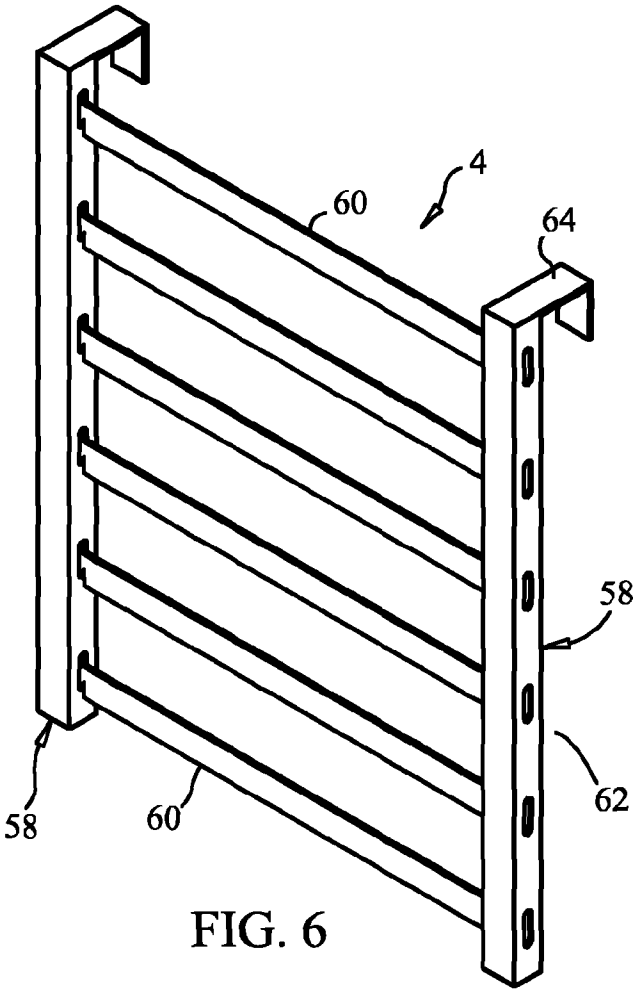
FIG. 6 is a perspective view a fourth embodiment of an award rack in accordance with the present invention.

With reference to FIG. 5, a fourth embodiment of the award rack 4 includes at least two bar hangers 58 and at least one notched bar 60. With reference to FIGS. 6-8, each bar hanger includes a hanger body 62 and an edge hanger end 64 that extends from one end of the hanger body 62. The hanger body 62 includes a U-shaped cross section. A plurality of first slots 66 are formed along a first side 68 of the hanger body 62 and a plurality of second slots 70 are formed along an opposing second side 72 of the hanger body 62. The first and second sides extend from a base section 65 of the hanger body 62. The first and second sides are folded substantially perpendicular to the base section 65 to form the U-shaped cross section. The edge hanger end 64 is folded into a U-shape as a portion of the base section 65.

The notch bar 60 includes a first notch 74 formed on a first end and a second notch 76 formed on a second end thereof. The first and second notches are sized to be received by first and second slots of two adjacent bar hangers 58. The edge hanger end 64 is sized to be received by a top edge of an object, such as a horse stall. A plurality of notched bars 60 may be hung between the two adjacent bar hangers 58.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A rack for retaining at least one award, comprising:

a strip of material;

at least one figurine extends from said strip of material;

at least one means for retaining a strap, each one of said at least one means for retaining a strap having a strap slot, said means for retaining a strap extends from said at least one figurine; and at least one strap, each one of said at least one strap having a first end and a second end, said strap slot is sized receive a cross section of said strap, said strap is retained in said means for retaining a strap, a length of said strap is slidable relative to said means for retaining a strap, said first end is removably secured to said second end, wherein said strip of material being suspended from a horizontal support by said at least one strap.

2. The rack for retaining at least one award of claim 1 wherein:

said means for retaining a strap is a strap holder, said strap holder includes a strap leg, an offset leg and a mounting leg, said strap leg extends from one end of said offset leg and said mounting leg extends from the other end of said offset leg in a direction opposite said strap leg.

3. The rack for retaining at least one award of claim 1, further comprising:

each one of said at least one strap having a strap member, a male locking member and a female locking member, one end of said strap member being secured to said male locking member and the other end of said strap member being secured to said female locking member.

4. A rack for retaining at least one award, comprising:

a strip of material;

a first strap holder is retained relative to one end of said strip of material, said first strap holder includes a first strap slot;

a second strap holder is retained relative to the other end of said strip of material, said second strap holder includes a second strap slot;

at least one figurine extends from said strip of material; and a first strap and a second strap, each said strap having a first end and a second end, said first strap slot is sized receive a cross section of said first strap, said first strap is retained in said first strap holder, said first strap holder retains said first strap outward from a front of said first strip of material, said second strap slot is sized receive a cross section of said second strap, said second strap is retained in said second strap holder, said second strap holder retains said second strap outward from said front of said strip of material, a length of said first strap is slidable relative to said strap holder, a length of said second strap is slidable relative to said second strap holder, said first end is removably secured to said second end, wherein said strip of material being suspended from a horizontal support by said first and second straps.

5. The rack for retaining at least one award of claim 4 wherein:

each one of said first and second strap holders includes a strap leg, an offset leg and a mounting leg, said strap leg extends from one end of said offset leg and said mounting leg extends from the other end of said offset leg a direction opposite said strap leg.

6. The rack for retaining at least one award of claim 4, further comprising:

said strap having a strap member, a male locking member and a female locking member, one end of said strap member being secured to said male locking member and the other end of said strap member being secured to said female locking member.

7. A rack for retaining at least one award, comprising:

a strip of material;

a first figurine extends from one end of said strip of material, said first figurine includes a first strap holder, said first strap holder includes a first strap slot;

a second figurine extends from the other end of said strip of material, said second figurine includes a second strap holder;

each said strap having a first end and a second end, said strap is retained in one of said first and second strap holders, said first end is removably secured to said second end, said first strap slot is sized receive a cross section of said strap, said first strap holder retains said first strap outward from a front of said strip of material, said second strap holder retains said second strap outward from a front of said strip of material, wherein said strip of material being suspended from a horizontal support by said first and second straps.

8. The rack for retaining at least one award of claim 7, further comprising:

said figurine represents the subject matter of the at least one award.

9. The rack for retaining at least one award of claim 7 wherein:

each one of said first and second strap holders includes a strap leg, an offset leg and a mounting leg, said strap leg extends from one end of said offset leg and said mounting leg extends from the other end of said offset leg a direction opposite said strap leg.

10. The rack for retaining at least one award of claim 7, further comprising:

said strap having a strap member, a male locking member and a female locking member, one end of said strap member being secured to said male locking member and the other end of said strap member being secured to said female locking member.

* * * * *